US007473136B2

(12) United States Patent
Hu et al.

(10) Patent No.: US 7,473,136 B2
(45) Date of Patent: Jan. 6, 2009

(54) ELECTRICAL CONNECTOR

(75) Inventors: Peng Hu, Kunshan (CN); Jia-Yong He, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,662

(22) Filed: Jan. 22, 2008

(65) Prior Publication Data

US 2008/0176449 A1 Jul. 24, 2008

(30) Foreign Application Priority Data

Jan. 22, 2007 (CN) ..... 2007 2 0033802
Jan. 22, 2007 (CN) ..... 2007 2 0033805

(51) Int. Cl.
*H01R 13/648* (2006.01)

(52) U.S. Cl. ..... 439/607; 439/79; 439/541.5

(58) Field of Classification Search ..... 439/79, 439/541.5, 607
See application file for complete search history.

(56) References Cited

U.S. PATENT DOCUMENTS 4,857,017 A * 8/1989 Erk ..... 439/695
4,955,819 A * 9/1990 Harting et al. ..... 439/79
5,252,080 A * 10/1993 Pesson ..... 439/79
5,453,016 A * 9/1995 Clark et al. ..... 439/79
5,785,537 A * 7/1998 Donahue et al. ..... 439/79
6,210,224 B1 * 4/2001 Wu ..... 439/607
6,383,024 B1 * 5/2002 Wang et al. ..... 439/607
6,503,102 B1 * 1/2003 Zhang et al. ..... 439/607
6,540,563 B1 * 4/2003 Hu et al. ..... 439/676
6,547,590 B2 4/2003 Zhu
6,719,587 B2 * 4/2004 Droesbeke et al. ..... 439/608
7,270,570 B1 9/2007 Hamner
7,311,556 B2 * 12/2007 Wan et al. ..... 439/607

FOREIGN PATENT DOCUMENTS

CN 2655454 10/2003

* cited by examiner

*Primary Examiner*—Tho D Ta
(74) *Attorney, Agent, or Firm*—Wei Te Chung

(57) ABSTRACT

An electrical connector for mating with a plug includes an insulative housing, a number of first contacts retained in the indulative housing. The insulative housing includes a first contact area. Each first contact has a contact portion extending into the first contact area, a soldering portion extending out of the insulative housing and a connecting portion extending therebetween. The connecting portions are arranged in several rows along a front to back direction of the housing. A first spacer is assembled to the insulative housing along the front to back direction and is arranged between the rows of the connecting portions to separate the first contacts from each other.

11 Claims, 9 Drawing Sheets

ELECTRICAL CONNECTOR

BACKGROUND OF THE INVENTION

1. Field of the Invention

The present invention relates to electrical connectors, and more particularly to electrical connector with two shielded mating interfaces so as to provide improved performance for high speed signal transmission.

2. Description of Related Art

With high development of electrical industry, the demand of signal transmission is increasing at the same time. But crosstalk, impedance, attenuation, propagation delay are the problems affecting high frequency performance of the signal transmission for a long time. U.S. Pat. No. 6,547,590 B2 discloses a stacked electrical connector which includes an insulative housing with a first connector mounted on an upper position and a second connector mounted on a lower position. Each connector includes a plurality of contacts retained therein. Each contact has a contact portion connecting with a mating plug, a soldering portion connecting with a circuit board and a connecting portion located therebetween. A spacer is assembled in the insulative housing and has a plurality of through holes. The connecting portions of the contacts are assembled into the holes along an up to down direction for decreasing the signal disturbance of contacts. Because the contacts of the first connector are much longer than others, the high frequency performance of the connector are reduced. The soldering portions of the contacts are easily to be distorted. Accordingly, it is hard that the contacts assembled into the holes along an up to down direction, and the high frequency performance of the contacts would have a bad effect. Furthermore, the insulative housing, the connectors and the spacer are separated from each other which result in a complex structure.

Hence, an electrical connector with improved high frequency performance is needed to solve the problem above.

BRIEF SUMMARY OF THE INVENTION

Accordingly, an object of the present invention is to provide an electrical connector with improved high frequency performance.

An electrical connector for mating with a plug comprises an insulative housing. The insulative housing comprises a first contact area with a plurality of first contacts retained therein. A first shield encloses the first contact area. Each first contact comprises a contact portion extending into the first contact area, a soldering portion extending out of the insulative housing and a connecting portion extending therebetween. The connecting portion comprises a horizontal portion and a vertical portion perpendicular to each other. The vertical portions are arranged in three rows along a front to back direction. A first spacer is attached to the insulative housing and comprises two opposite side walls with a plurality of ribs to separate the vertical portions of the first contacts from each other.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
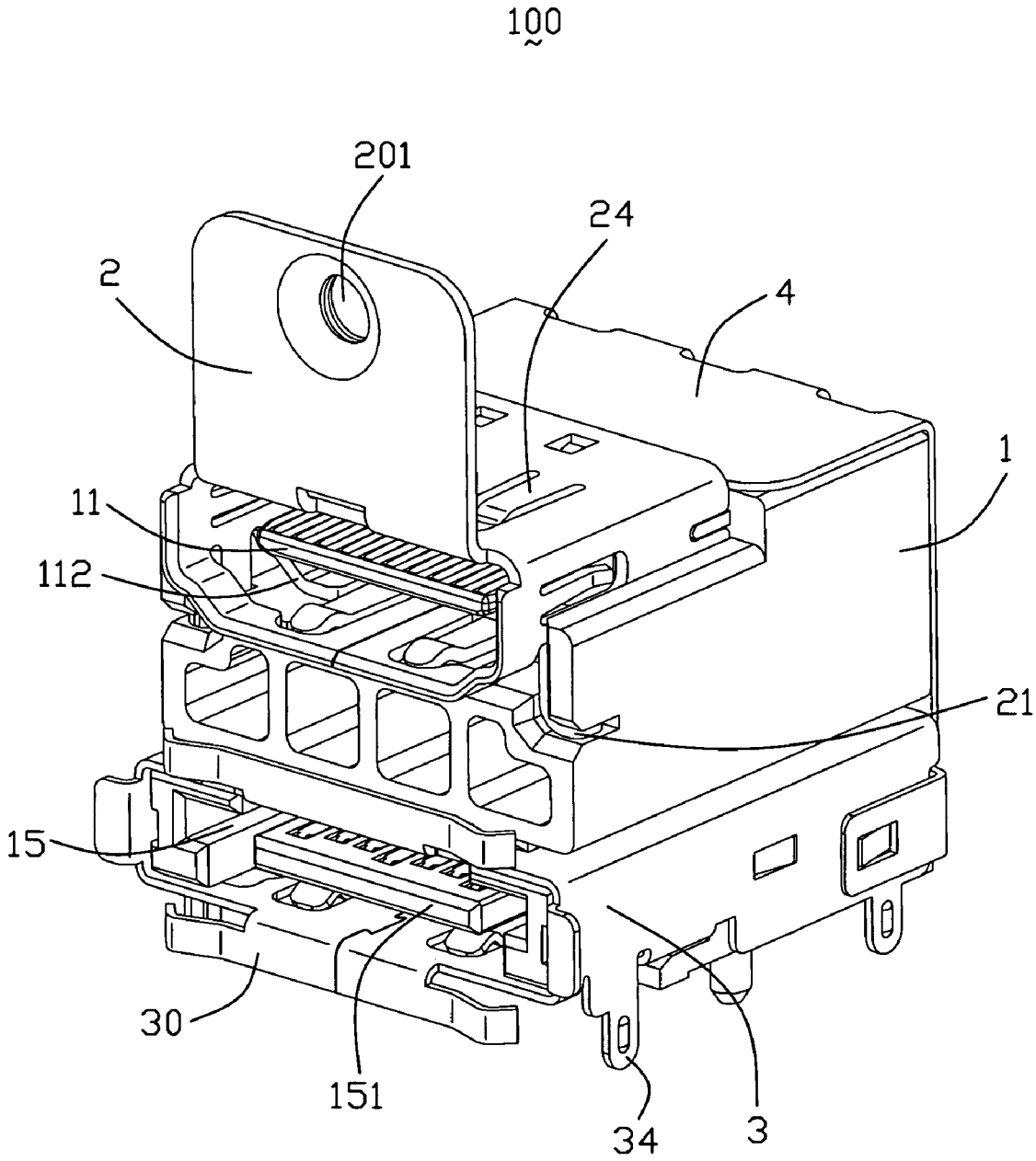
FIG. 1 is a perspective view of the preferred embodiment of an electrical connector according to the present invention.
Figure 2:
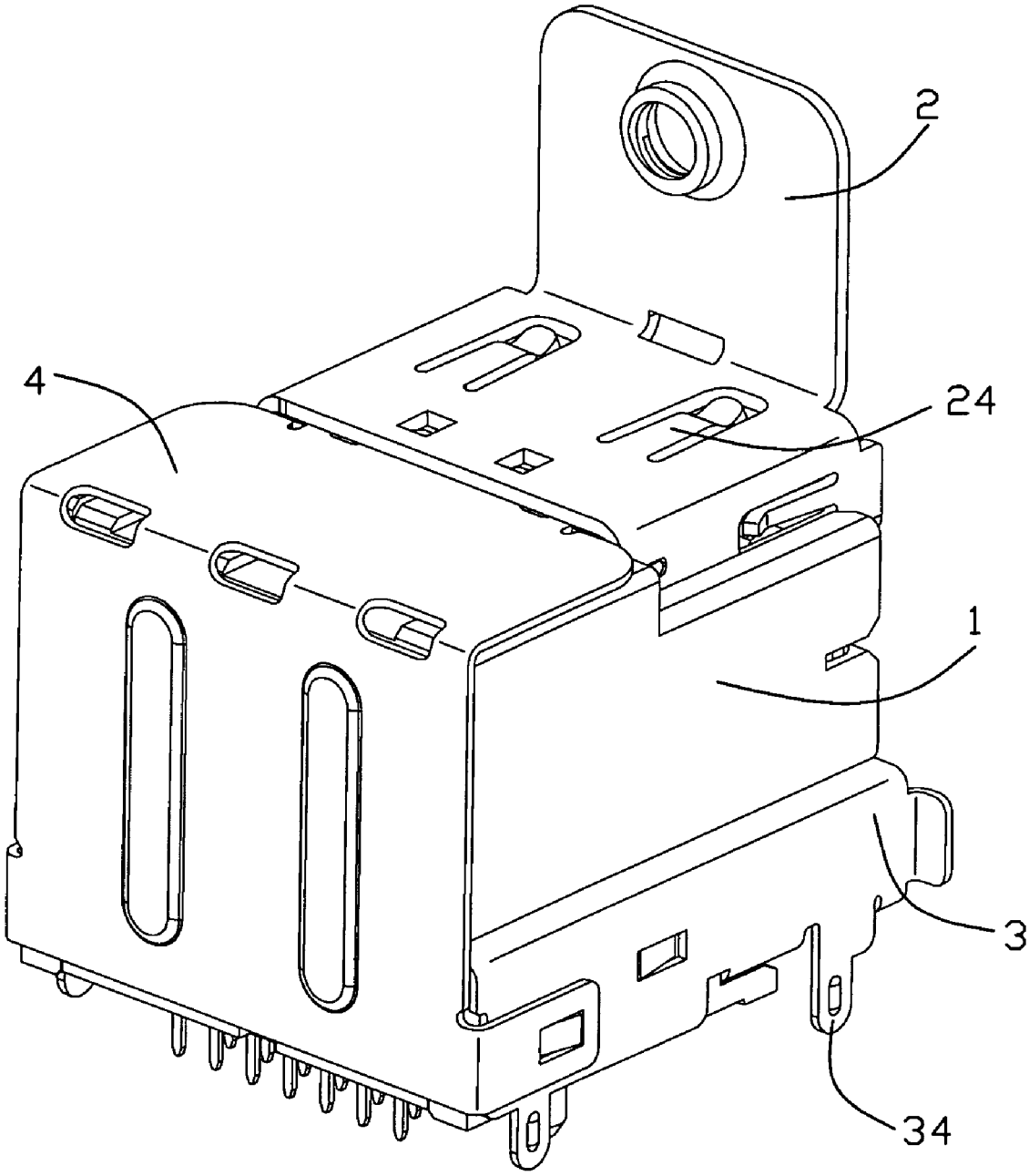
FIG. 2 is another perspective view of the electrical connector shown in FIG. 1, while taken from a different aspect.
Figure 3:
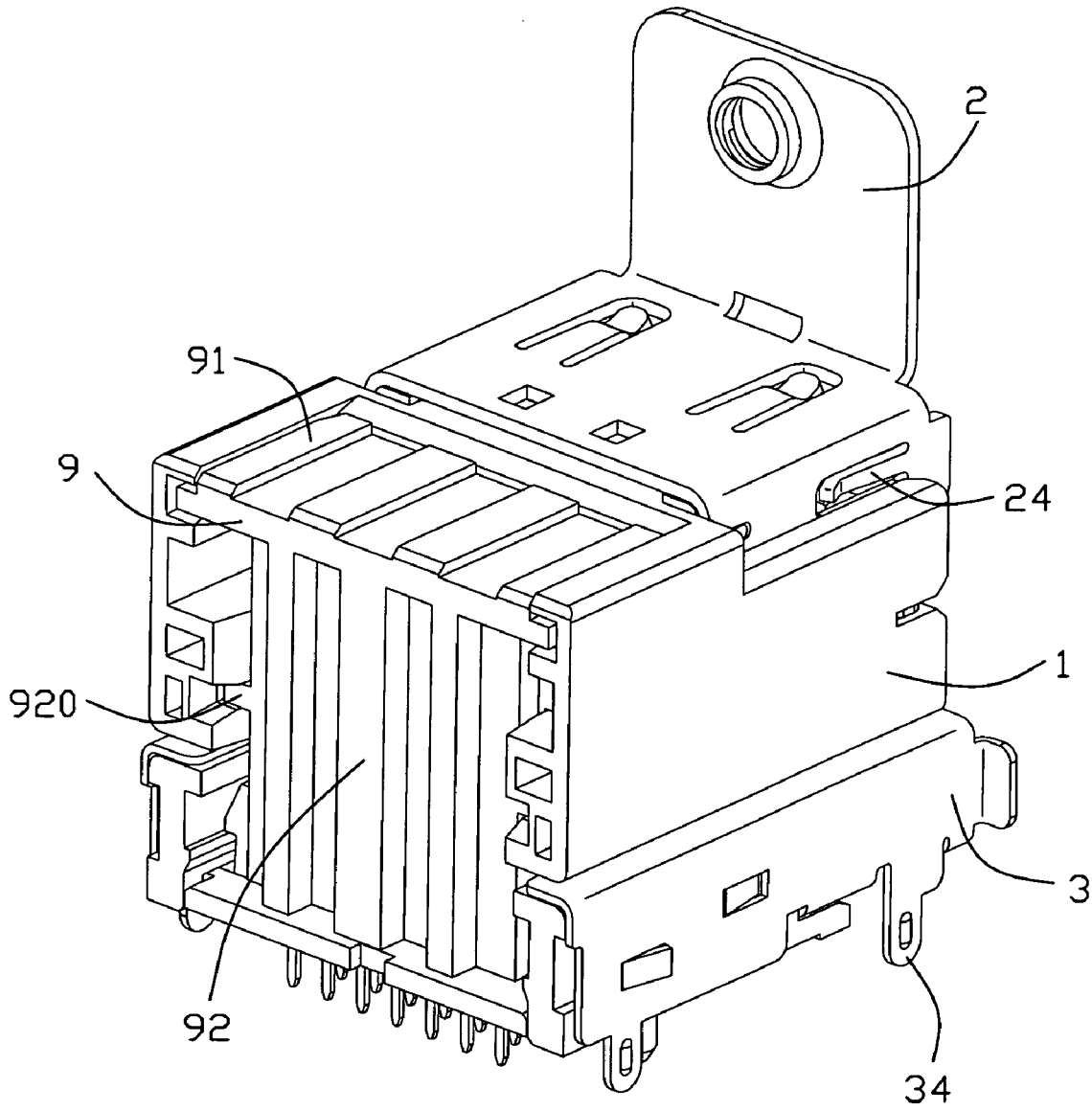
FIG. 3 is similar to FIG. 2, while a third shield is detached therefrom.
Figure 9:
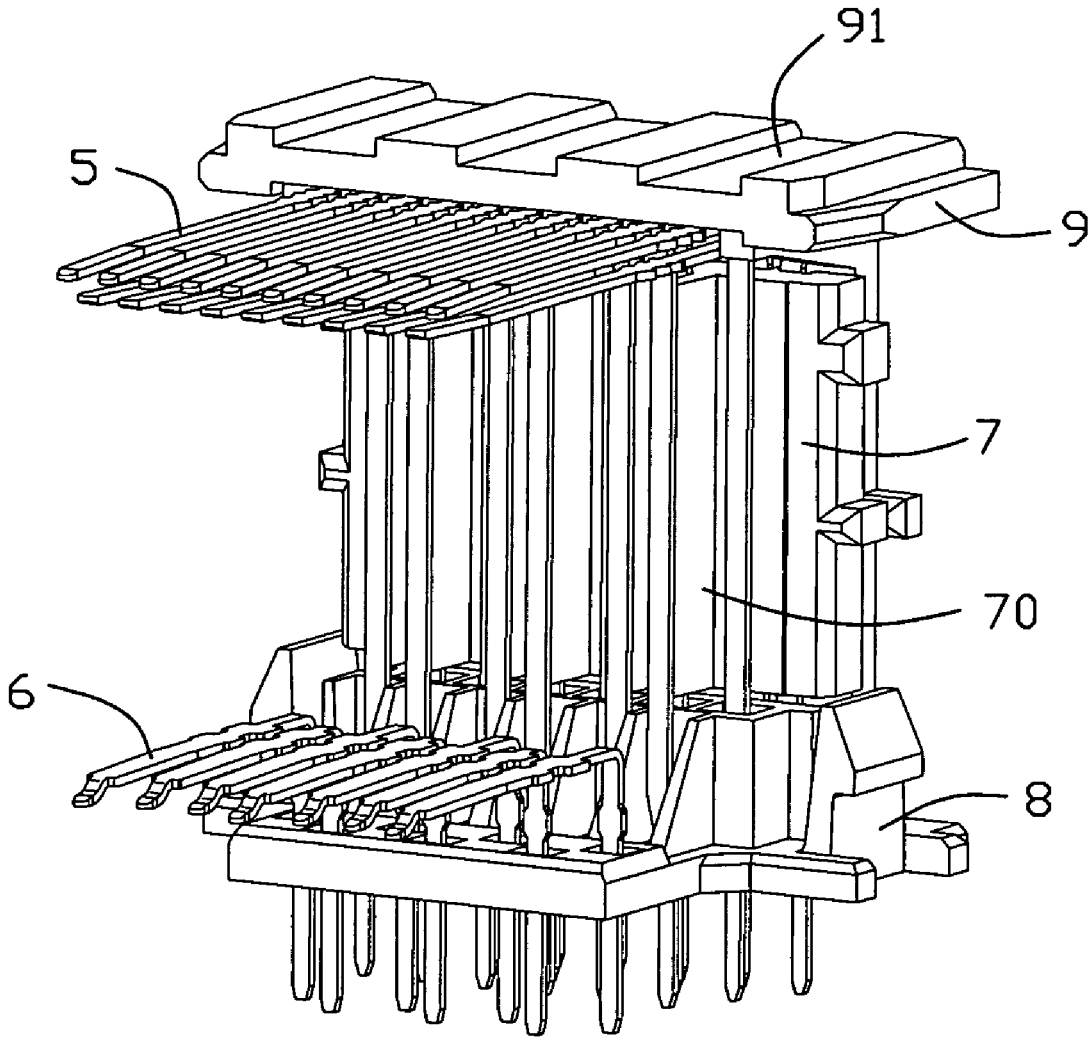
FIG. 9 is a partial assembled view of the electrical connector.

Referring to FIGS. 1 9, an electrical connector 100 for mating with a plug (not shown) is disclosed in accordance with the present invention. The electrical connector 100 comprises an insulative housing 1, a shield means mounted on the insulative housing 1, a plurality of contacts retained in the insulative housing 1, a first spacer 7 arranged between the contacts, a second spacer 9 covering the contacts, and a third spacer 8 mounted at a lower position of the insulative housing 1.

Figure 4:
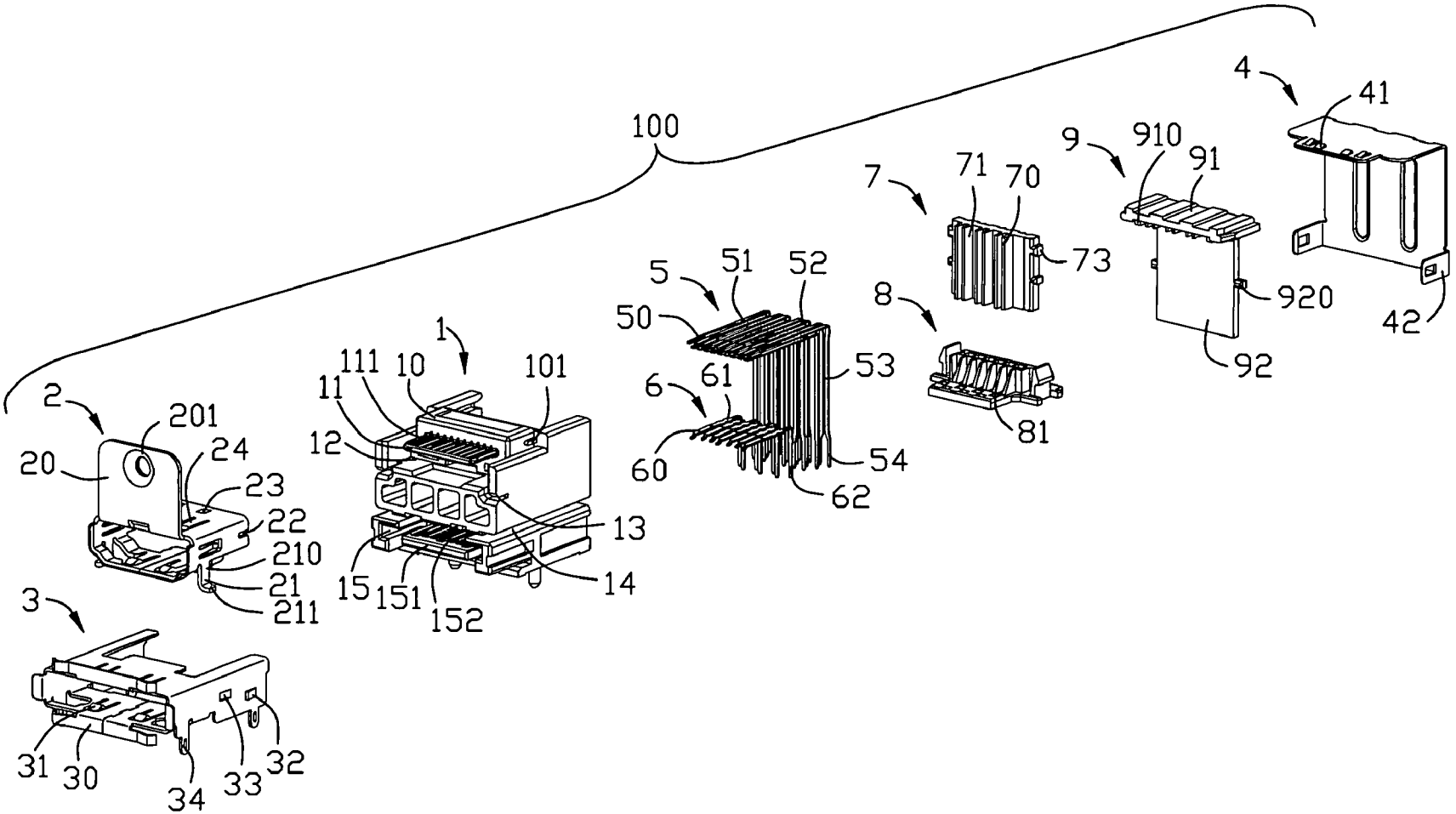
FIG. 4 is an exploded perspective view of the electrical connector shown in FIG. 1.
Figure 5:
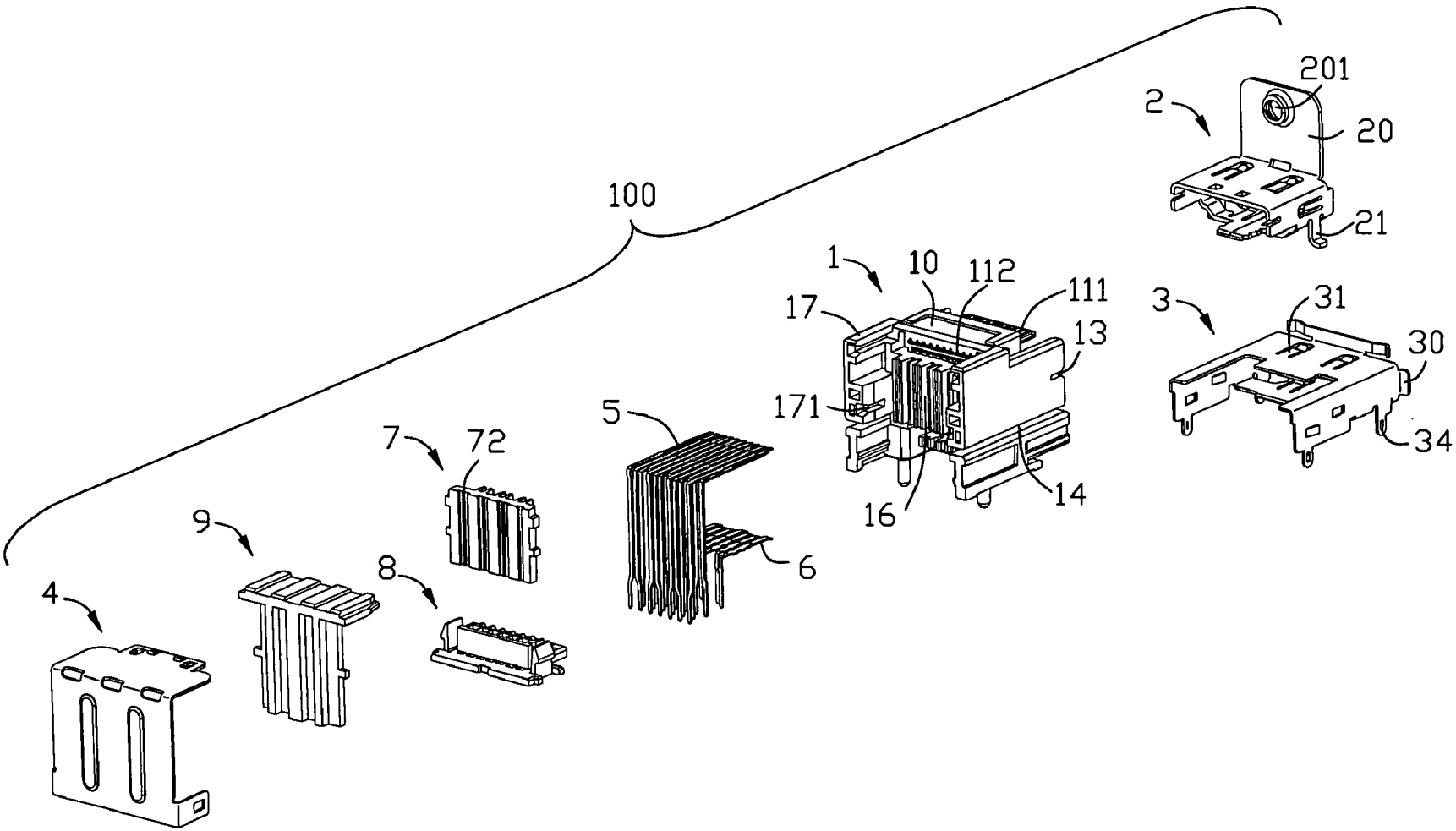
FIG. 5 is a view similar to FIG. 4, while taken from another aspect.
Figure 6:
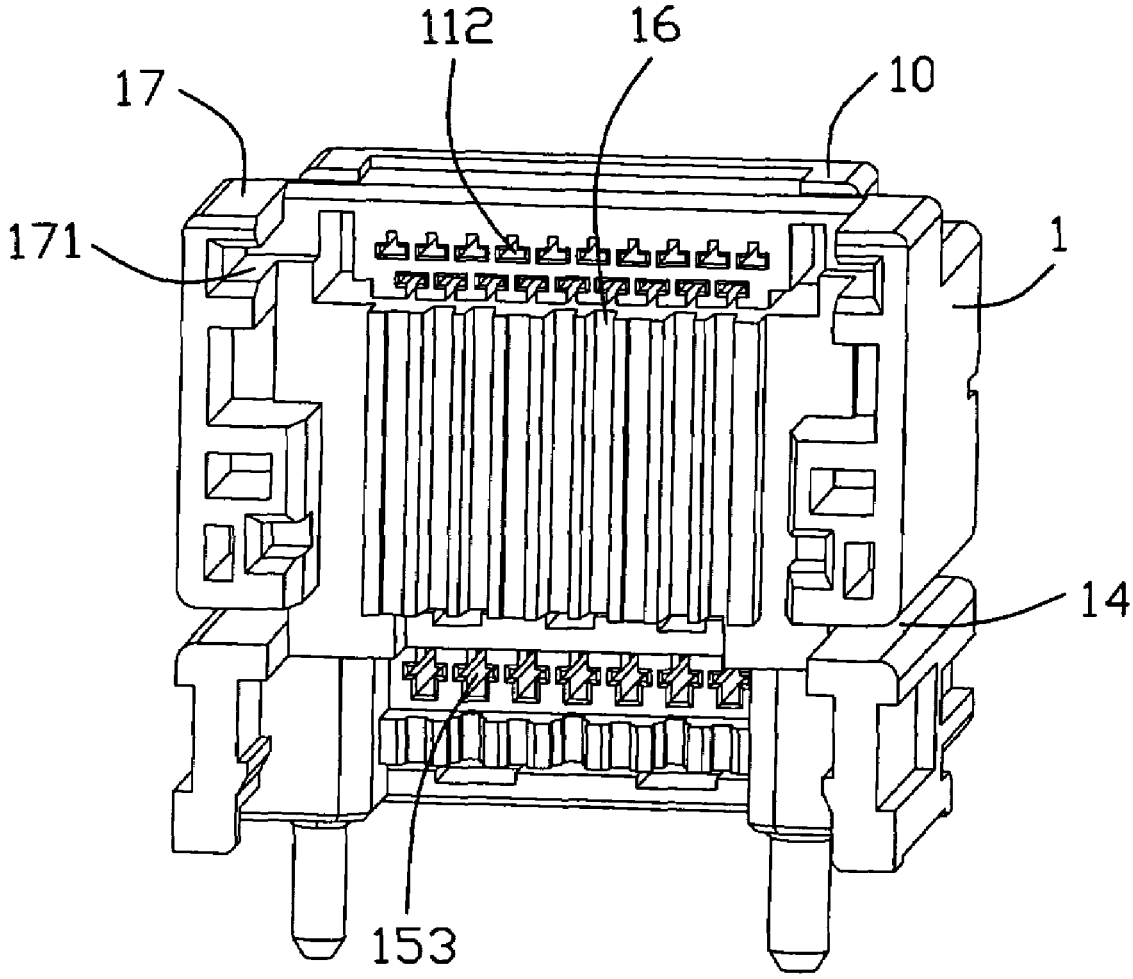
FIG. 6 is a perspective view of an insulative housing of the electrical connector.
Figure 7:
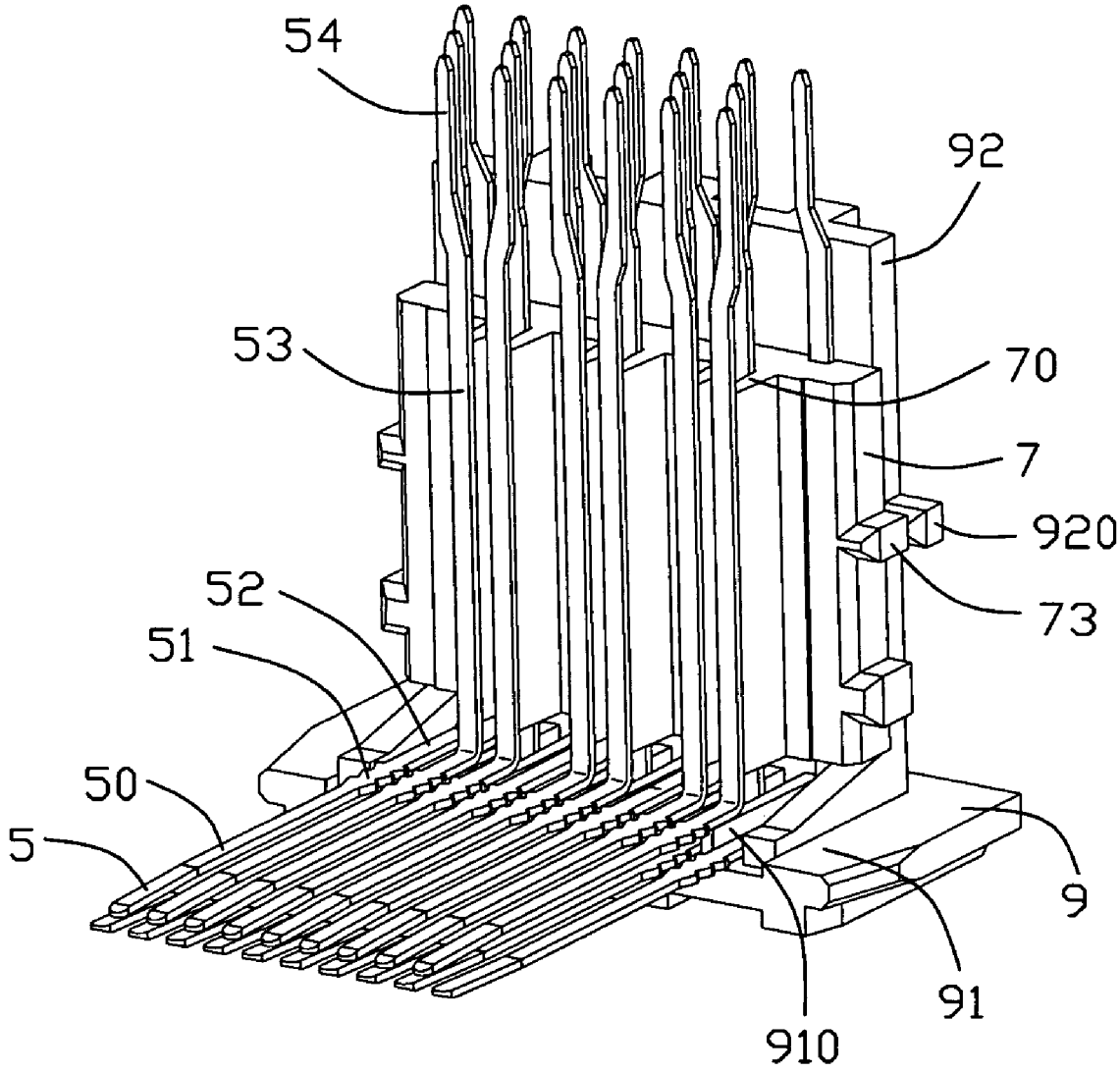
FIG. 7 is a partial assembled view of a plurality of first contacts, a first spacer and a second spacer.
Figure 8:
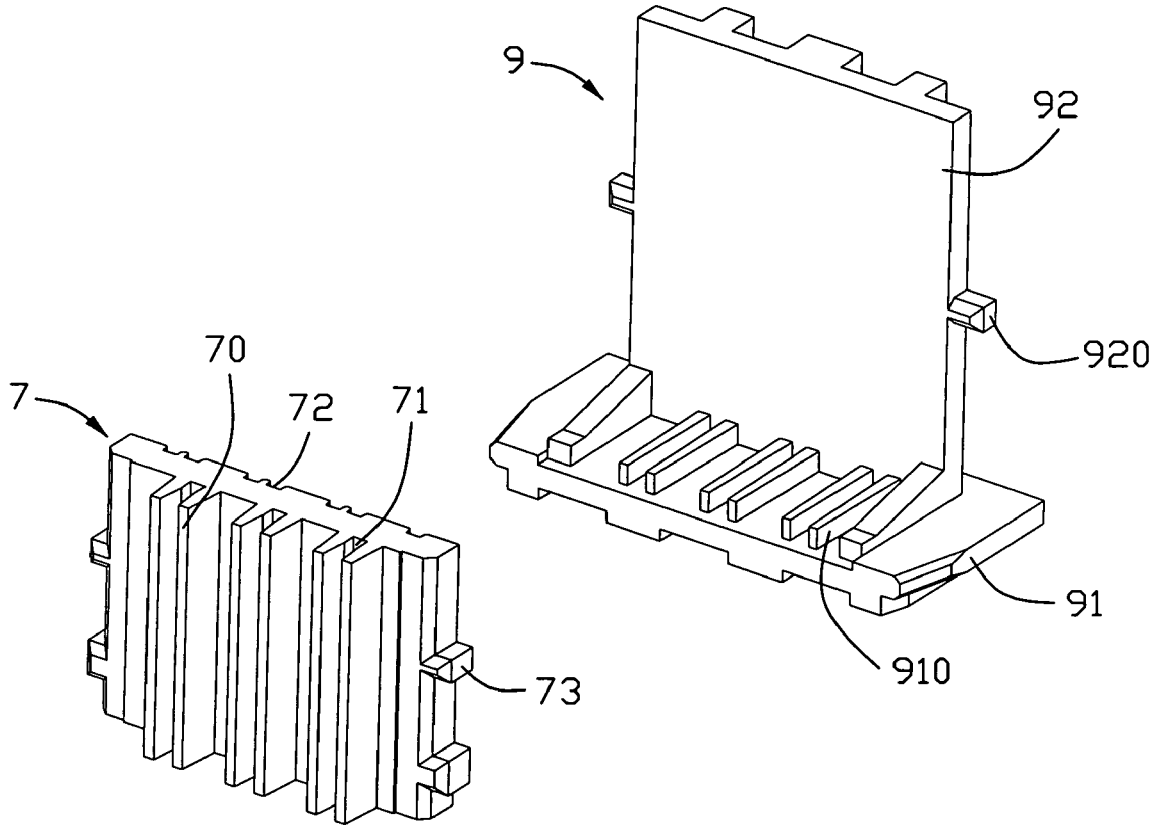
FIG. 8 is a perspective view of the first spacer and the second spacer of the electrical connector shown in FIG. 7.

Referring to FIGS. 4,5,6, the insulative housing 1 is made of insulative material, and has a base section 10 with a first contact area 12 at an upper position and a second contact area 15 at a lower position. The insulative housing 1 also has an unshielded spacing section (not labeled) separating the first and second contact areas 12, 15. The first contact area 12 has a first tongue 11 extending from the base section 10. The second contact area 15 has a second tongue 151 extending from the base section 10 and parallel with the first tongue 11. The first tongue 11 defines a plurality of passageways 111 in opposed upper and lower surfaces thereof. The base section 10 defines a plurality of mounting holes 112 communicating with the passageways 111 to retain the contacts. The second tongue 151 defines a plurality of passageways 152 in an upper surface thereof. The base section 10 defines a plurality of mounting holes 153 communicating with the passageways 152. A pair of protrusions 101 are formed on two sides of the base section 10. The insulative housing 1 includes two side walls 17. Each side wall 17 defines an indentation 13 at a front end thereof. The indentations 13 are located below the first contact area 12 and communicate with the first contact area 12. Further more, each side wall 17 defines a groove 14 extending though the insulative housing 1 between the unshielded spacing section and the second contact area 15, and a plurality of retaining slots 171 at an inner side thereof. The insulative housing 10 defines a plurality of grooves 16 running through opposed top and bottom surfaces thereof.

The shield means is made of a conductive metal plate and includes a first shield 2 enclosing the first contact area 12, a second shield 3 enclosing the second contact area 15 and a third shield 4 connecting the first shield 2 and the second shield 3.

The first shield 2 is mounted on the upper position of the insulative housing 10 and located between the side walls 17. The first shield 2 comprises a locking portion 20 extending upwardly from a front end thereof. The locking portion 20 defines a locking hole 201 for fixing the electrical connector 100 to a board of a device (not shown). A pair of locking barbs 21 extend from two sides of the first shield 2. Each locking barb 21 presents as L-shaped and includes a first section 210 extending downwardly and a second section 211 extending outwardly from the first section 210. The first section 210 affixes to the side walls 17. The second section 211 is retained in the indentation 13. Thereby the front of the first shield 2 would have a steady fixation so as to avoid distortion. The first shield 2 defines a pair of recesses 22 in two sides thereof to receive the protrusions 101 of the insulative housing 10, and a plurality of apertures 23 in an upper wall thereof. The first shield 2 has a plurality of engaging arms 24 extending into the first contact area 12.

The second shield 3 is mounted on the lower position of the insulative housing 10 along the groove 14, and comprises a plurality of grounding flanges 30 which are bended outwardly from the front end thereof. The second shield 3 has a plurality of engaging arms 31 extending into the second contact area 15. The second shield 3 includes a pair of locking tangs 32 extending outwardly from two sides thereof and a pair of agnail 33 interfering with the insulative housing 10. A pair of mounting legs 34 extend downwardly from two sides of the second shield 3 to connect with a circuit board (not shown).

The third shield 4 is mounted on the back of the insulative housing 10, and includes a plurality of tabs 41 received in the apertures 23 of the first shield 2 and a pair of retaining portions 42 to engage with the locking tangs 32 of the second shield 3.

The contacts include a plurality of first contacts 5 retained in the first contact area 12 and second contacts 6 retained in the second contact area 15. Each first contact S has a securing portion 51 retained in the mounting holes 112, a contact portion 50 extending horizontally from the securing portion 51 to connect the plug (not shown), a soldering portion 54 extending out of the insulative housing 1 and a connecting portion extending between the securing portion 51 and soldering portion 54. The connecting portion includes a horizontal portion 52 and a vertical portion 53 perpendicular to each other. The contact portions 50 of the first contacts 5 are arranged in two rows along an up to down direction of the insulative housing and received in the passageways 111 of the first tongue 11. The horizontal portions 52 are also arranged in two rows. The vertical portions 53 are arranged in three rows along a front to back direction of the insulative housing 1. The three rows of the vertical portions 53 include a front row, a middle row and a rear row. The vertical portions 53 of the front row are received in the grooves 16 respectively. Thereby the vertical portions 53 of the front row are separated from each other. Each second contact 6 has a securing portion 61 retained in the mounting holes 153, a contact portion 60 extending horizontally from the securing portion 61 and received in the passageways 152, and a soldering portion 62 bending downwardly from the securing portion 61.

The first spacer 7 is assembled to the insulative housing along the front to back direction. The first spacer 7 includes two opposite sides (not labeled). The first spacer 7 has a plurality of ribs 70 on front side near the insulative housing 1 and a plurality of other ribs (not labeled) on rear side. A plurality of slots 72 are formed between the ribs of the rear side. The vertical portions 53 of the middle row are assembled in clearances 71 between the ribs 70 so as to separate from each other. When the first spacer 7 assembled in the insulative housing 1, the ribs 70 engage with the grooves 16 and press the vertical portions 53 of the front row. Then the middle row and the front row are enclosed absolutely by the insulative housing 1 and the first spacer 7 so as to separate from air. The vertical portions 53 of the rear row are received in the slots 72 and separated from each other. The first spacer 7 has a plurality of blocks 73 engaging with the retaining slots 171 of the insulative housing 1. The clearances 71 and the slots 72 of the first spacer 7 are all opening.

The second spacer 9 is mounted on the back of the insulative housing 1, and includes a first section 91 extending horizontally to cover the horizontal portions 52 and a second section 92 extending vertically to cover the vertical portions 53. The first section 91 has a plurality of ribs 910 at lower surface thereof. The horizontal portions 52 of two rows are received between the ribs 910 or affix to lower surface of the ribs 910. Then the ribs 910 can separate the horizontal portions 52. The second section 92 affixes to ribs of the rear side of the first spacer 7 and absolutely encloses the vertical portions 53 of the rear row with the first spacer 7. The second section 92 has a pair of blocks 920 on two sides thereof to engage with the retaining slots 171 of the insulative housing 1.

The third spacer 8 is mounted on the lower position of the insulative housing 1, and defines a plurality of holes 81 running through the top and bottom surfaces thereof to position the soldering portions of the first contacts 5 and the second contacts 6.

According to the present invention, the first shield 2 has a pair of locking barbs 21 retained in the indentations 13 of the insulative housing 1. Thereby the front of the first shield 2 will has a steady fixation. The fixation of the locking portion 20 would not bring the frame of the first shield 2 to distort. Furthermore, the electrical connector 100 has the first spacer 7, the second spacer 9 and the third spacer 8 to separate the contacts from each other, and to make each contacts enclosed by insulative material, thereby to increasing the relative static permittivity between the contacts. Thus, the high frequency performance of the electrical connector 100 is improved. In addition, the first spacer 7 and the second spacer 9 are attached to the insulative housing along the front to back direction and hold the contacts firmly at the connecting portions to keep the contacts from damage and affirm the electrical connector assembled easily.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing defining a first contact area to mate with a plug;

a first shield enclosing the first contact area;

a plurality of first contacts retained in the insulative housing, each contact comprising a contact portion extending into the first contact area, a soldering portion extending out of the insulative housing and a connecting portion extending therebetween, the connecting portion comprising a horizontal portion and a vertical portion perpendicular to each other, the vertical portions of the first contacts being arranged in three rows along a front to back direction; and a first spacer attached to the insulative housing and comprising two opposite sides with a plurality of ribs to separate the vertical portions of the first contacts from each other;

wherein the three rows of the vertical portions comprise a front row, a middle row and a rear row, and wherein the middle row is located between the ribs on one side of the first spacer and the rear row is located between the ribs on another side of the first spacer;

wherein the housing defines a plurality of grooves at a rear end thereof to receive the front row therein, the ribs on one side of the first spacer engaging with the grooves of the housing, the vertical portions of the front and middle rows being enclosed by insulative housing and the first spacer simultaneously.

2. The electrical connector according to claim 1, wherein the first spacer is assembled to the insulative housing along the front to back direction.

3. The electrical connector according to claim 1, wherein the insulative housing comprises a tongue in the first contact area and the contact portions are arranged on opposed upper and lower surfaces of the tongue.

4. The electrical connector according to claim 1, further comprising a second spacer mounted to the insulative housing, and wherein the second spacer comprises a first section covering the horizontal portions and a second section covering the vertical portions of the rear row.

5. The electrical connector according to claim 4, wherein the first section has a plurality of ribs to separate the horizontal portions, and the second section encloses the vertical portions of the rear row with the first spacer.

6. The electrical connector according to claim 1, further comprising a second contact area below the first contact area, and wherein a plurality of second contacts are retained in the second contact area and a second shield encloses the second contact area, the second contact having a contact portion extending into the second contact area and a soldering portion extending out of the insulative housing.

7. The electrical connector according to claim 6, further comprising a third spacer mounted to a lower end of the insulative housing, and wherein the third spacer defines a plurality of through holes to position the soldering portions of the first and the second contacts.

8. The electrical connector according to claim 6, further comprising a third shield connecting the first shield and the second shield, the second shield comprises a plurality of mounting legs to connect with a circuit board.

9. An electrical connector, comprising:

an insulative housing comprising two side walls and defining a first contact area to mate with a plug;

a metal shield mounted between the side walls and enclosing the first contact area, the metal shield comprising a pair of locking barbs extending from two sides thereof to engage with the side walls of the insulative housing;

a plurality of first contacts retained in the insulative housing, each contact comprising a contact portion extending into the first contact area, a soldering portion extending out of the insulative housing and a connecting portion extending therebetween, the connecting portions being arranged in a plurality of rows along a front to back direction;

a spacer attached to the insulative housing and arranged between the rows of the connecting portions to separate the connecting portions from each other;

wherein the spacer is assembled to the insulative housing along the front to back direction, and wherein the spacer comprises a plurality of blocks to engage with the insulative housing;

wherein the spacer has two opposed sides, and wherein each side is formed with a plurality of ribs and the connecting portions are fitted therebetween.

10. The electrical connector according to claim 9, wherein the insulative housing defines a pair of indentations communicated with the first contact area, and wherein the locking barbs present as L shaped and each comprises a first section affixing to the side walls and a second section received in the indentation.

11. The electrical connector according to claim 9, further comprising a second contact area below the first contact area with a plurality of second contacts retained therein and another metal shield enclosing the second contact area.

* * * * *